US005992375A

United States Patent [19]

Nagashima

[11] Patent Number: 5,992,375

[45] Date of Patent: Nov. 30, 1999

[54] FOUR-STROKE CYCLE INTERNAL COMBUSTION ENGINE

[75] Inventor: Akira Nagashima, Kawasaki, Japan

[73] Assignee: Kioritz Corporation, Tokyo, Japan

[21] Appl. No.: 09/033,848

[22] Filed: Mar. 3, 1998

[30] Foreign Application Priority Data

Mar. 4, 1997 [JP] Japan ..... 9-065362

[51] Int. Cl.[6] ..... F02B 75/02; F02B 75/12

[52] U.S. Cl. ..... 123/317; 123/311

[58] Field of Search ..... 123/311, 317, 123/76

[56] References Cited

U.S. PATENT DOCUMENTS 4,995,350 2/1991 Kumagai et al. .
5,579,735 12/1996 Todero et al. .
5,586,523 12/1996 Kawahara et al. .

FOREIGN PATENT DOCUMENTS 53-46733 12/1978 Japan .
54-3084 2/1979 Japan .

*Primary Examiner*—Noah P. Kamen
*Assistant Examiner*—Jason Benton
*Attorney, Agent, or Firm*—Thelen Reid & Priest, L.L.P.

[57] ABSTRACT

The present invention provides a small and light four-stroke cycle internal combustion engine applicable to a compact power working machine. A cylinder head is provided with an ignition plug and an exhaust port with an exhaust valve. A crankcase is fixed to the bottom of a cylinder block are to form a closed crank chamber. On the cylinder block formed are a first port and a second port which are open to a combustion chamber and are opened and closed by a piston, with the second port being communicated with the crank chamber through a communicating passage, the first port being connected to a carburetor, and an air-fuel mixture mixed with lubricating oil being supplied from the carburetor through this first port to the crank chamber.

17 Claims, 11 Drawing Sheets

FOUR-STROKE CYCLE INTERNAL COMBUSTION ENGINE

BACKGROUND OF THE INVENTION

The present invention relates to a four-stroke cycle internal combustion engine suitable for use in a compact power working machine such as a portable trimmer, a lawn mower, a chain saw, or the like.

DESCRIPTION OF THE PRIOR ART

A two-stroke cycle internal combustion engine is smaller and lighter and produces higher power compared with a four-stroke cycle internal combustion engine. Therefore, a compact air-cooled two-stroke cycle gasoline engine (hereinafter, "a two-stroke cycle engine") is generally employed as a power source for a compact power working machine such as a portable trimmer or the like, as disclosed in Japanese Patent Public Disclosure No. Sho 53-46733 and Japanese Patent Public Disclosure No. Sho 54-3084.

A two-stroke cycle engine, however, consumes comparatively more fuel and is unstable in running because it generally employs a scavenging system by gas-flow, and also has a defect in that some problems arise from its constituents in the exhaust gas.

The inventor of the present invention developed in accordance with the present invention, a four-stroke cycle engine which is free from the disadvantages stated above but is substantially as compact as and as light as the two-stroke cycle engine.

That is, the object of the present invention is to provide a compact and light four-stroke cycle internal combustion engine which can be applicable for usage in a compact power working machine.

SUMMARY OF THE INVENTION

In the present invention, the technical problems stated hereabove can be solved by a four-stroke cycle internal combustion engine having a working chamber formed between a cylinder head and a piston slidably inserted into a bore of a cylinder block, and an ignition plug mounted on the cylinder head comprising an exhaust port which is formed in the cylinder block and is connected to a an exhaust system component; an exhaust valve which opens and closes the exhaust port; a crankcase which is connected to the cylinder block at the bottom of thereof to form a closed crank chamber therebetween; a first port which is formed in the cylinder block in communication with the working chamber, the first port being opened and closed by the piston and being connected to an intake system component for supplying lubricating oil together with fuel; a second port which is formed in the cylinder block in communication with the working chamber, the second port being opened and closed by the piston and being opened when the piston is located in the vicinity of its bottom dead center; and a communicating passage connecting the second port to the crank chamber.

In the engine in accordance with the present invention, an air-fuel mixture filling the crankcase is supplied through the communicating passage from the second port to the working chamber (intake stroke). Then, the air-fuel mixture streamed into the working chamber is compressed by a rising piston (compression stroke), and is ignited just before reaching the top dead center, and subsequently follows an expansion stroke and an exhaust stroke when the exhaust valve is opened.

During the exhaust stroke, a combustion gas in the working chamber is physically thrust out by the rising piston. In this engine, since the combustion gas is forcibly exhausted out by the piston, unlike the scavenging by gas flow which is common in a conventional two-stroke cycle internal combustion engine, the variation in the residual gas can be reduced. Further, it creates a favorable condition for securing stable running of the engine and also allows an easier control of emissions.

Following the completion of the exhaust stroke, a negative pressure is produced in the working chamber by the piston traveling downwardly while the exhaust valve is closed. When the piston reaches the vicinity of the bottom dead center, the second port is opened whereby a mixture in the crank chamber streams from the second port through the communicating passage into the working chamber as described above. During a series of these strokes, the crankshaft revolves twice.

In the engine of the present invention, the lubricating oil together with the air-fuel mixture streams from the intake system component through the first port into the crankcase and lubricates the inside of the engine. Therefor, this engine does not need an oil-pan which is usually installed in a four-stroke cycle internal combustion engine. Ommision of the oil pan enables the height of the engine to be substantially reduced to the same height as a conventional two-stroke cycle engine. Since a cylinder head of the present invention which is different from that of a usual four-stroke cycle engine has neither an intake port nor an intake valve and only has an exhaust system, there is a high degree of freedom for selection of a location of the exhaust port and the location of the exhaust system component. This provides an advantage of fewer design restrictions when this engine is employed as a power source for a compact power working machine.

Since the construction having two ports in the cylinder block in the present invention is similar to that of a conventional two-stroke cycle engine having a scavenging port and an exhaust port, there is an economical advantage that an engine of the present invention can be easily manufactured in the same production line as a two-stroke cycle engine.

The above and other objects and features of the present invention will become apparent from the following description made with reference to the accompanying drawings.

DESCRIPTION OF THE PREFERRED EMBODIMENTS

Preferred embodiments of the present invention will be detailed with reference to the attached drawings.

Figure 1:
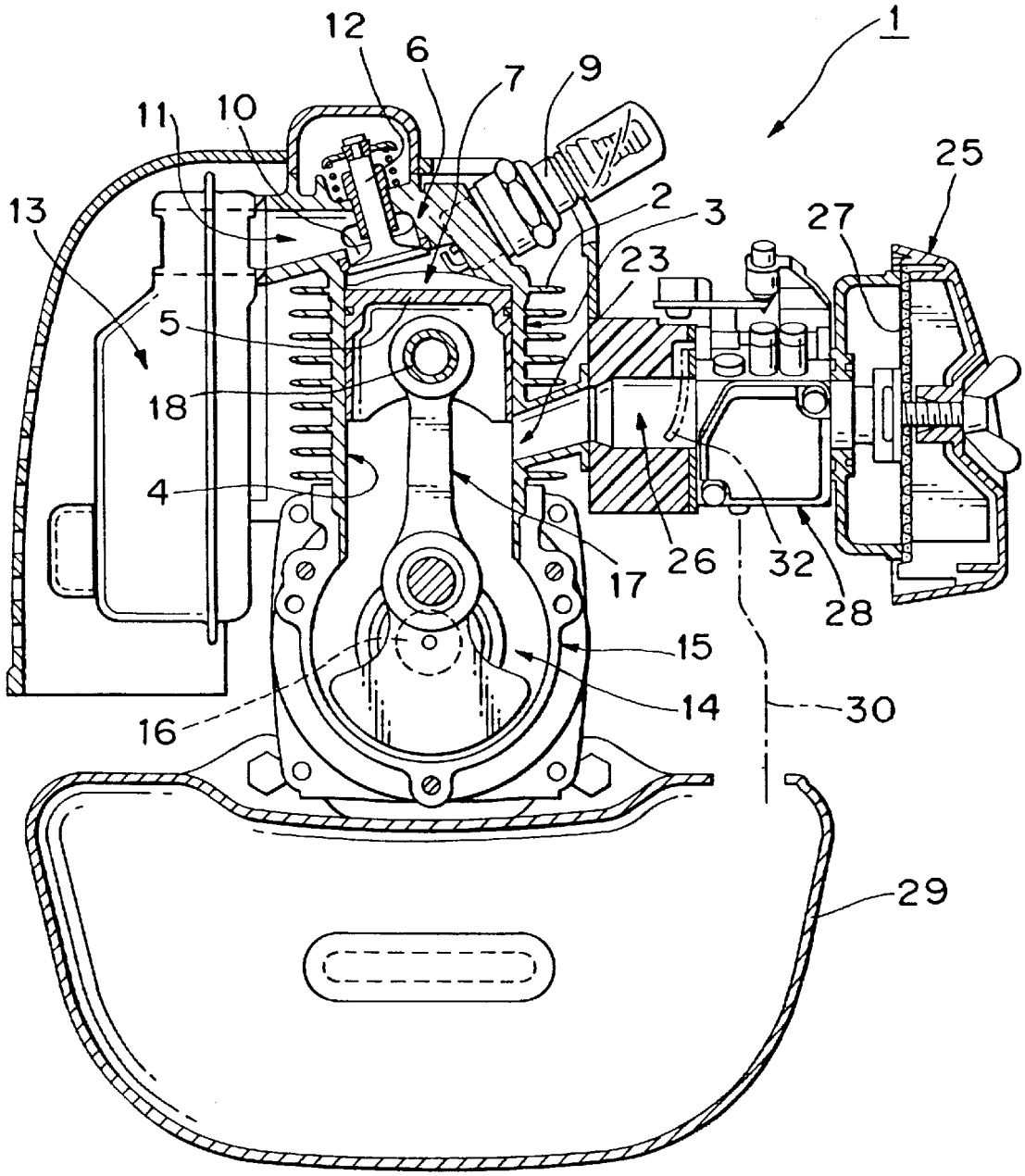
FIG. 1 is a longitudinal sectional view of an engine in accordance with a first embodiment taken in a direction normal to the crankshaft axis.
Figure 2:
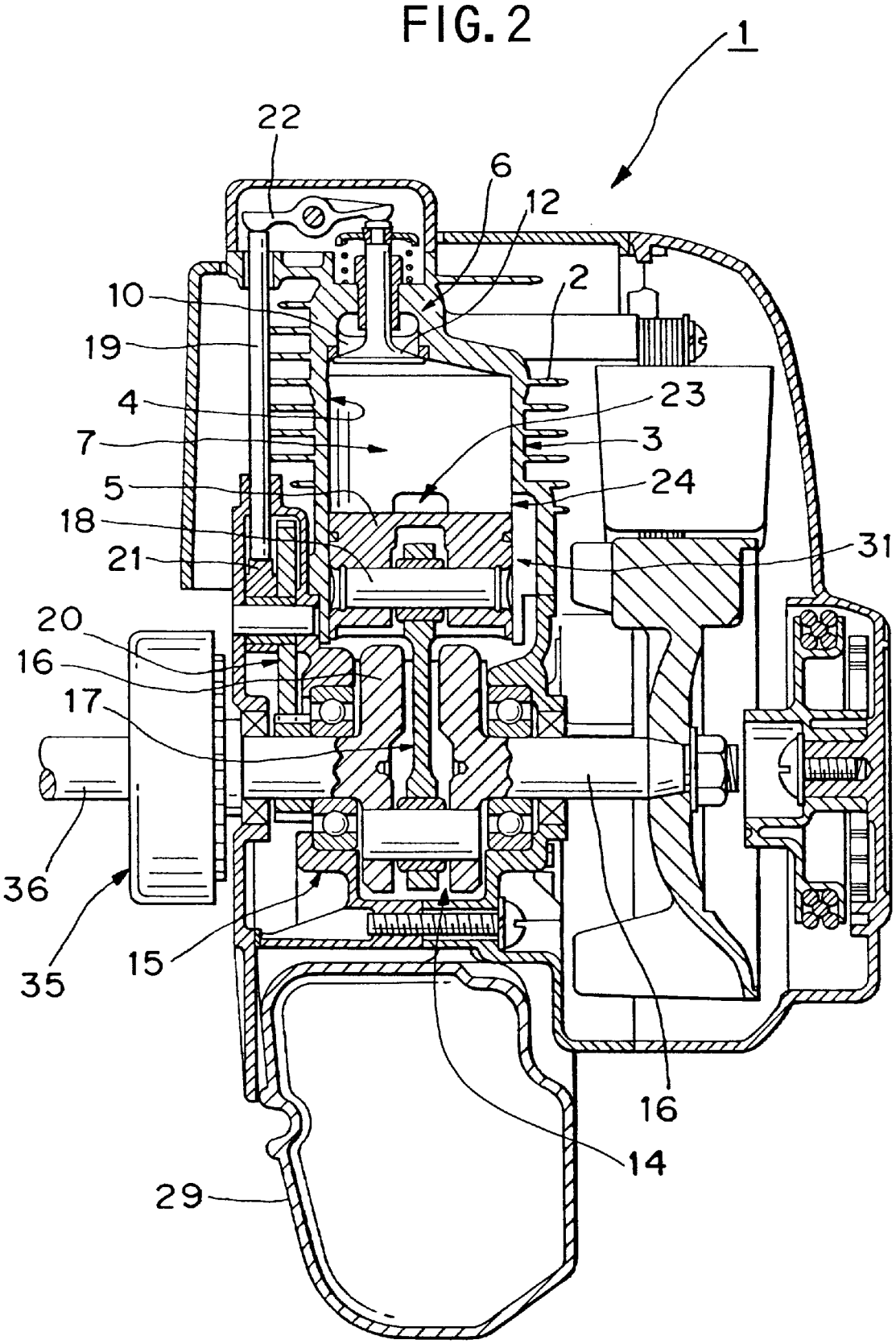
FIG. 2 is a longitudinal sectional view of the engine in accordance with the first embodiment taken in a direction along the crankshaft.
Figure 3:
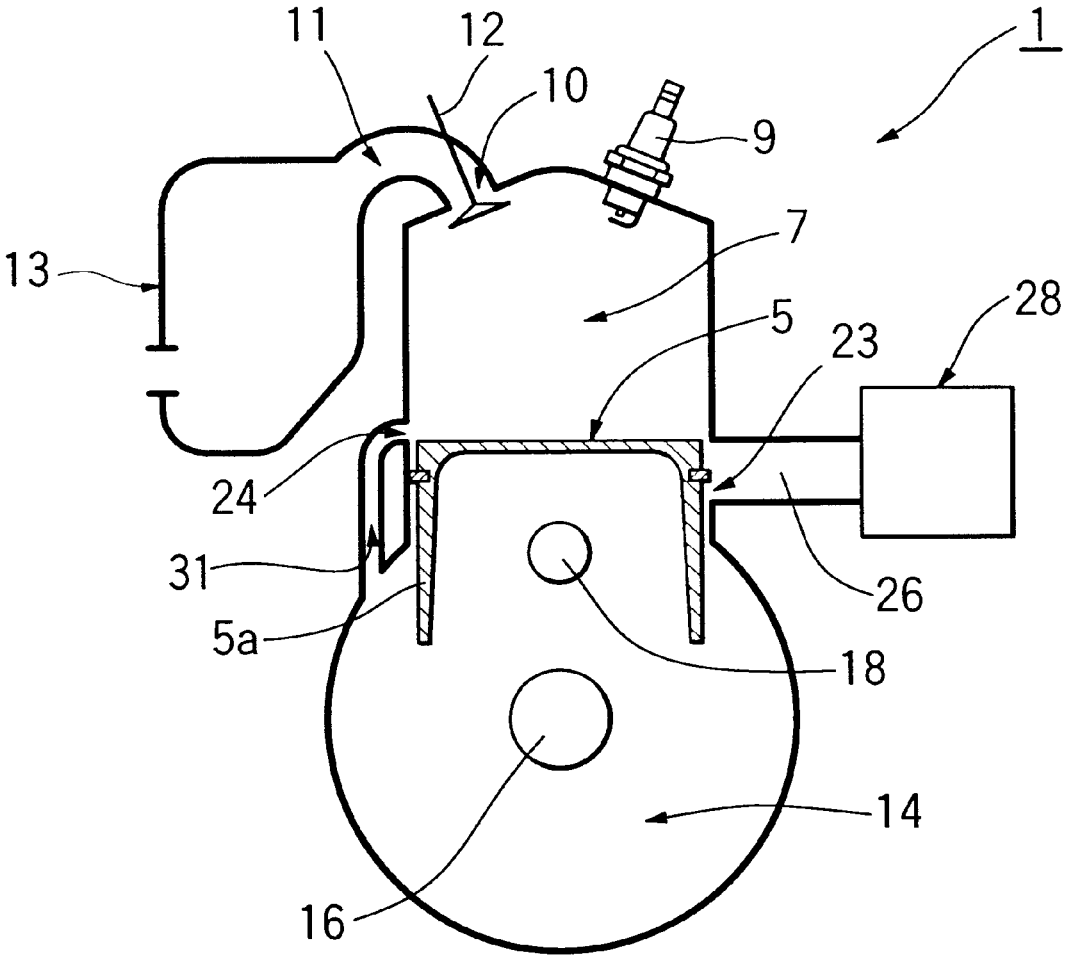
FIG. 3 is a diagrammatic view of the engine in accordance with the first embodiment.

FIG. 1 to FIG. 3 show a first embodiment of an air-cooled single cylinder engine to which the present invention is directed. FIG. 1 is a longitudinal sectional view of an engine in accordance with the first embodiment taken in the direction normal to its crankshaft axis. FIG. 2 is a longitudinal sectional view of an engine which corresponds to that in FIG. 1 and is taken in the direction along its crankshaft. Further, FIG. 3 is a schematic diagram of an engine in which a piston is positioned at its bottom dead center.

FIG. 1 shows an engine 1 with an engine displacement of 20 cc–30 cc which is relatively small and shows an exemplary form of an engine as a power source for usage in a portable trimmer. The engine 1 has a cylinder block 3 with cooling fins 2, and a working chamber or combustion chamber 7 formed between a cylinder head 6 and a piston 5 slidably inserted into a bore 4 of the cylinder block 3. The cylinder head 6 has an ignition plug 9 which is arranged to communicate with the combustion chamber 7 and an exhaust passage 11 which has an exhaust port 10 directing toward the combustion chamber 7. The exhaust port 10 is opened and closed by an exhaust valve 12. A muffler 13 as an exhaust system component is connected to the exhaust passage 11 at the other end thereof so as to release the exhaust gas into the atmosphere through the exhaust port 10, exhaust passage 11 and muffler 13.

A crankcase 15 is fixed to the bottom of the cylinder block 3 so as to form a closed crank chamber 14 therebetween. A crankshaft 16 located in the crank chamber 14 is connected to the piston 5 through a connecting rod 17 and a piston pin 18. As a valve mechanism in this engine 1, a rocker arm type of mechanism is employed to drive the exhaust valve 12. That is, the engine 1 has a push rod 19 extending upwardly and downwardly at a side of the cylinder block 3 (refer to FIG. 2), and the lower end of the push rod 19 is via a gear train 20 brought into contact with a cam face of a cam 21 rotated by the crankshaft 16. The upper end of the push rod 19 is engaged with the exhaust valve 12 through a rocker arm 22.

Two ports, i.e., a first port 23 and a second port 24, are formed at the cylinder block 3. They are directed toward the bore 4 and opened and closed by the piston 5. Intake system components are installed at a portion of the peripheral wall of the bore 4 of the cylinder block 3 in the vicinity of the first port 23. The intake system components include a component defining an intake passage 26 connected to the first port 23, and an air filter 27 of an air cleaner 25, a diaphragm-type carburetor 28, and its throttle valve (not illustrated), or the like, arranged from an upstream end to a downstream side of the intake passage 26.

A transmission shaft 36 is connected to the output side of the crankshaft 16 (left side in FIG. 2) via a centrifugal clutch 35. A fuel tank 29 in which gasoline mixed with some lubricating oil is contained is arranged below the engine 1 and next to the crankcase 15. The gasoline and the lubricating oil in this fuel tank 29 are supplied to the carburetor 28 through a tube 30, and are atomized through this carburetor 28 and then discharged into the intake passage 26. The second port 24 is communicated to the crank chamber 14 through a communicating passage 31 (refer to FIG. 3).

Figure 4B:
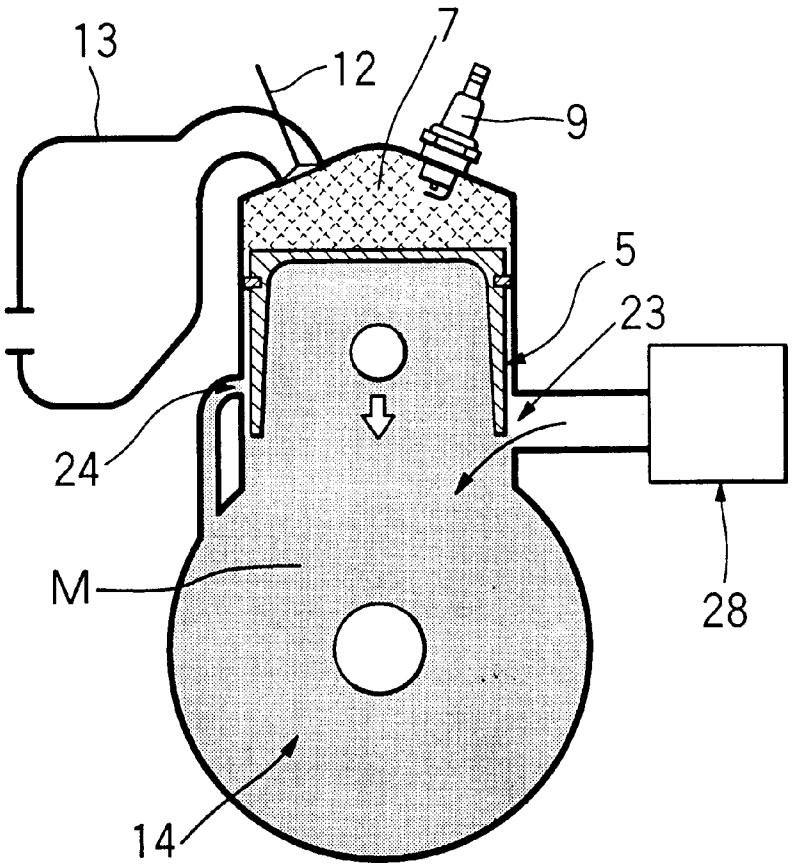
FIG. 4A and FIG. 4B illustrate the operation of the engine in accordance with the first embodiment and show the engine at an early stage of an expansion stroke and the engine at a mid-stage of the same stroke, respectively.
Figure 4A:
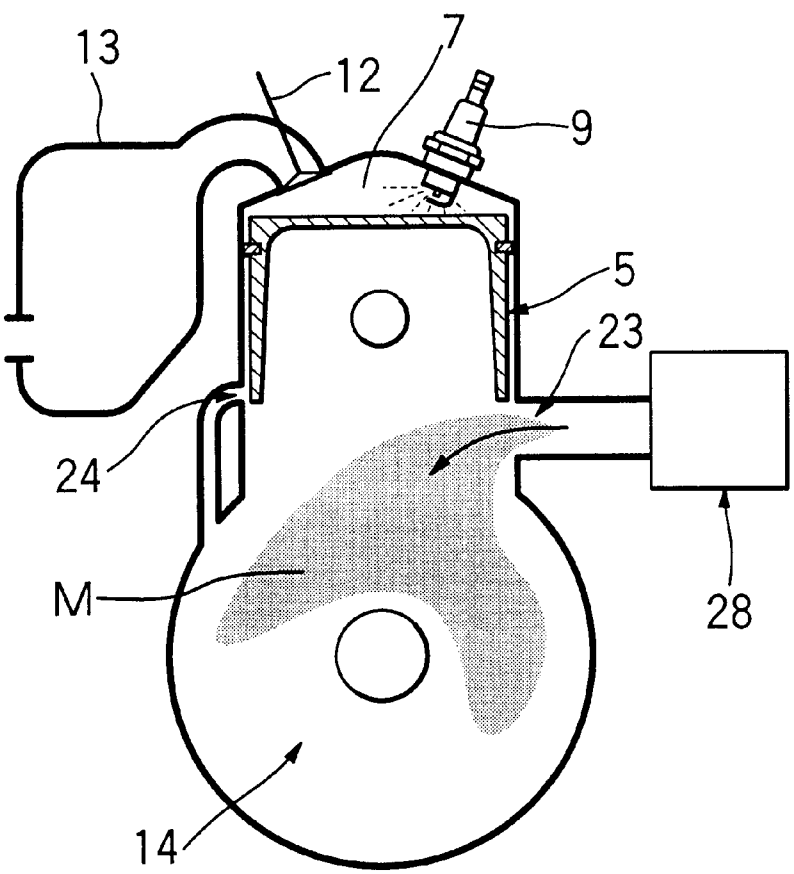
Figure 4D:
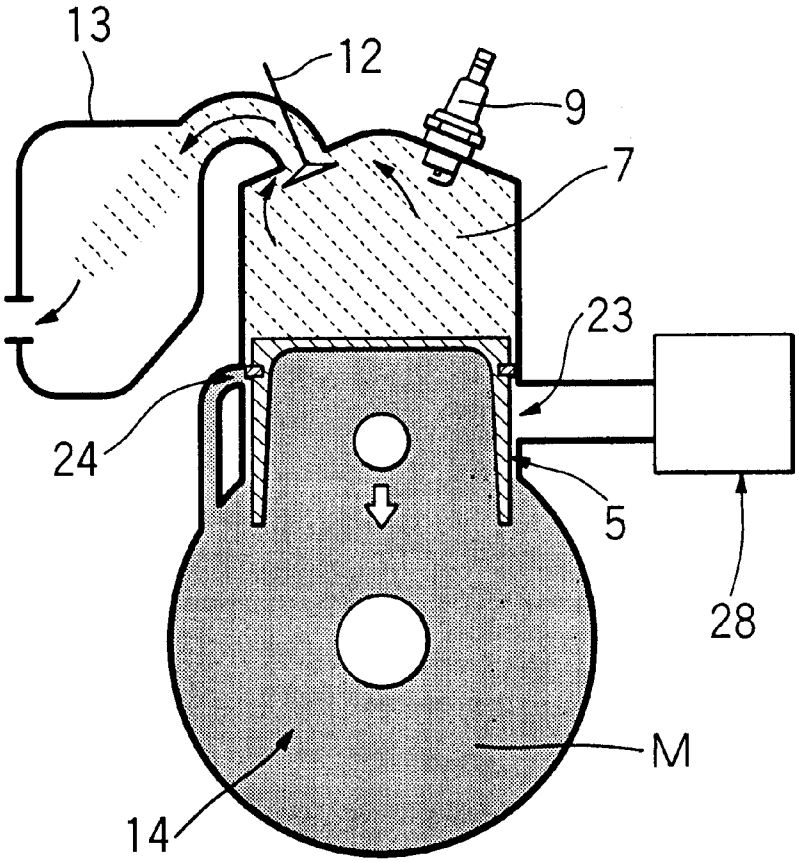
FIG. 4C and FIG. 4D illustrate the operation of the engine of the first embodiment and show the engine just before an exhaust stroke and the engine just after the beginning of the exhaust stroke, respectively.

Referring to FIG. 3 and FIG. 4A, the opening positions of the first and second ports 23, 24 and a length of a skirt portion 5*a* of the piston 5 will be described. First, the first port 23 communicating with the carburetor 28 is located at the highest possible position so that the first port 23 is kept to be closed by the piston even when the piston 5 reaches the bottom dead center as in FIG. 3. On the other hand, the second port 24 communicating with the crank chamber 14 is located at a location where the second port 24 is fully opened when the piston 5 almost reaches the bottom dead center. The length of the skirt portion 5*a* of the piston 5 is designed so as to allow the second port 24 to be kept closed even when the piston 5 reaches the top dead center as shown in FIG. 4A and so that the first port 23 is fully opened when the piston 5 reaches the top dead center (refer to FIG. 4A)

Although the mechanical structure, of the engine 1 is similar to that of a conventional two-stroke cycle engine in that the first and second ports 23, 24 opened and closed by the piston 5 are formed in the cylinder block 3, this engine 1 is a four-stroke cycle engine, as will be understood from the description below referring to FIG. 4A to FIG. 4L. To make this point clear and to avoid confusion with the two-stroke cycle engine, the second port 24 directed to the combustion chamber 7 and the first port 23 directed to the crank chamber 14 will henceforth be called an intake port and a suction port, respectively.

FIG. 4A to FIG. 4L show the sequential operation of the engine 1. The states or steps in one complete cycle in the operation of the engine 1 in order in FIG. 4A through FIG. 4L), and repeat beginning with FIG. 4A. During one cycle in the operation, the crankshaft 16 revolves twice (rotations of 720°). Referring to FIG. 4A to FIG. 4L, each state in the operation cycle of the engine 1 will hereafter be described.

FIG. 4A shows an explosion stroke of the engine 1 in which the piston 5 is substantially positioned at the top dead center. Although, in FIG. 4A, the ignition plug 9 is shown to be at ignition for convenience in explaning the drawing, the plug 9 is actually ignited just before the piston 5 reaches the top dead center as those skilled in the art will obviously understand. When the engine 1 is in this state, an air-fuel mixture M streams from the side of the carburetor 28 through the suction port 23 into the crank chamber 14.

Figure 4C:
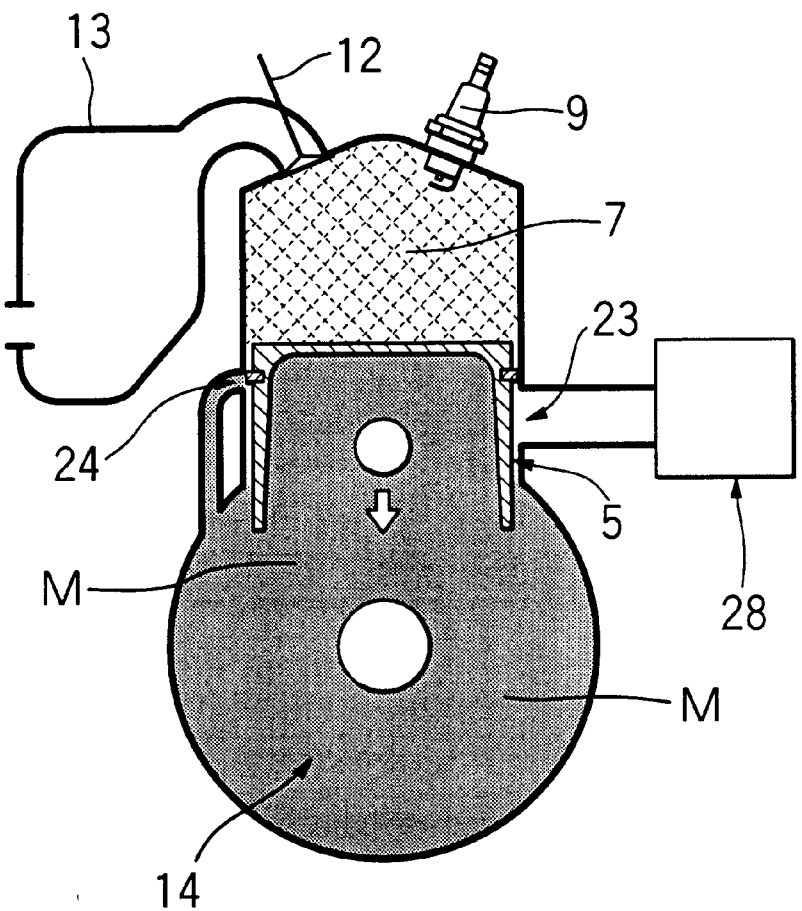
Figure 4F:
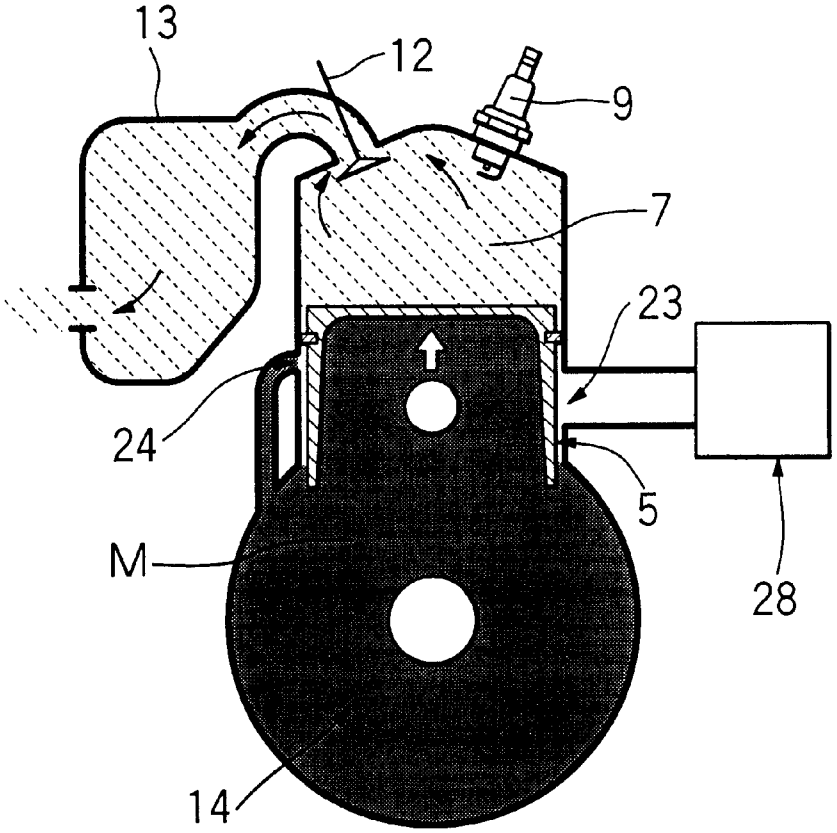
FIG. 4E and FIG. 4F illustrate the operation of the engine in accordance with the first embodiment and show the engine whose piston is positioned at its bottom dead center during an exhaust stroke and the engine whose piston is traveling upwardly during the exhaust stroke, respectively.

FIG. 4B and FIG. 4C show an expansion stroke of the engine 1. During this expansion stroke, until the port 23 is closed by the piston 5 traveling downwardly, the air-fuel mixture M streams through the suction port 23 into the crank chamber 14.

FIG. 4D to FIG. 4H show an exhaust stroke of the engine 1. This exhaust stroke, as understood from FIG. 4D, begins before the piston 5 reaches the bottom dead center (advanced opening of exhaust valve). The exhaust valve 12 is set to open during the period in which the intake port 24 is closed.

Figure 4E:
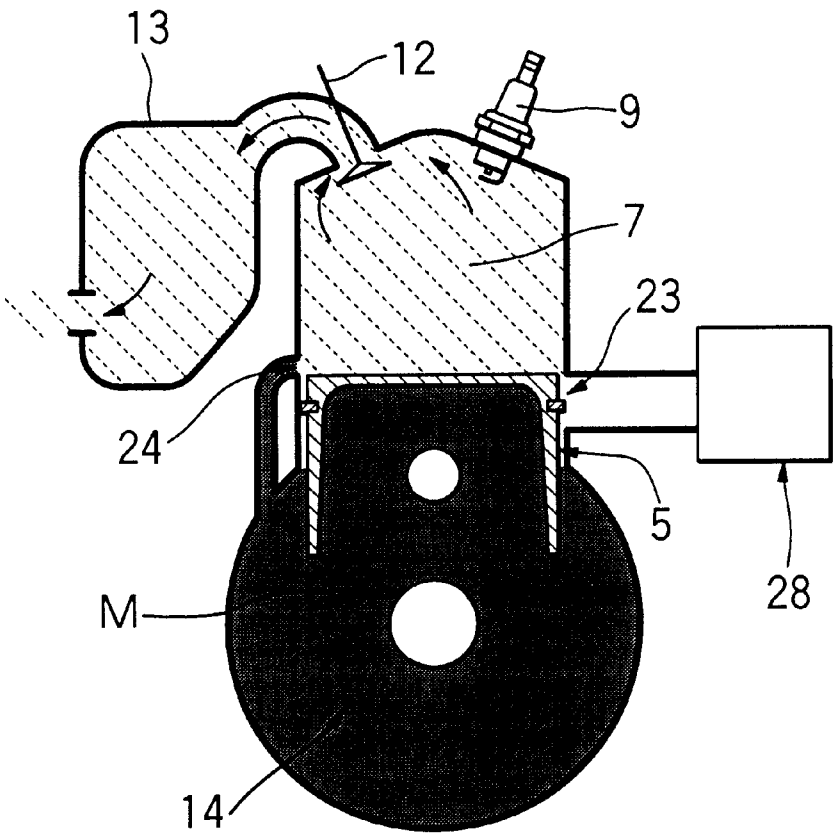
Figure 4H:
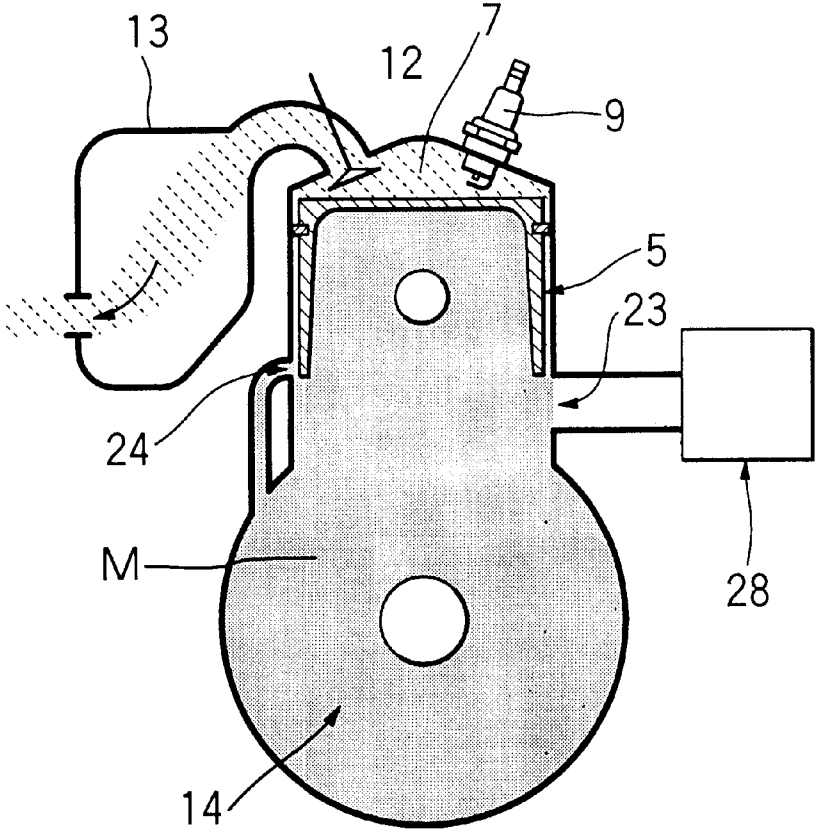
FIG. 4G and FIG. 4H illustrate the operation of the engine in accordance with the first embodiment and show the engine at a final stage of an exhaust stroke and the engine just before the completion of the exhaust stroke, respectively.
Figure 4G:
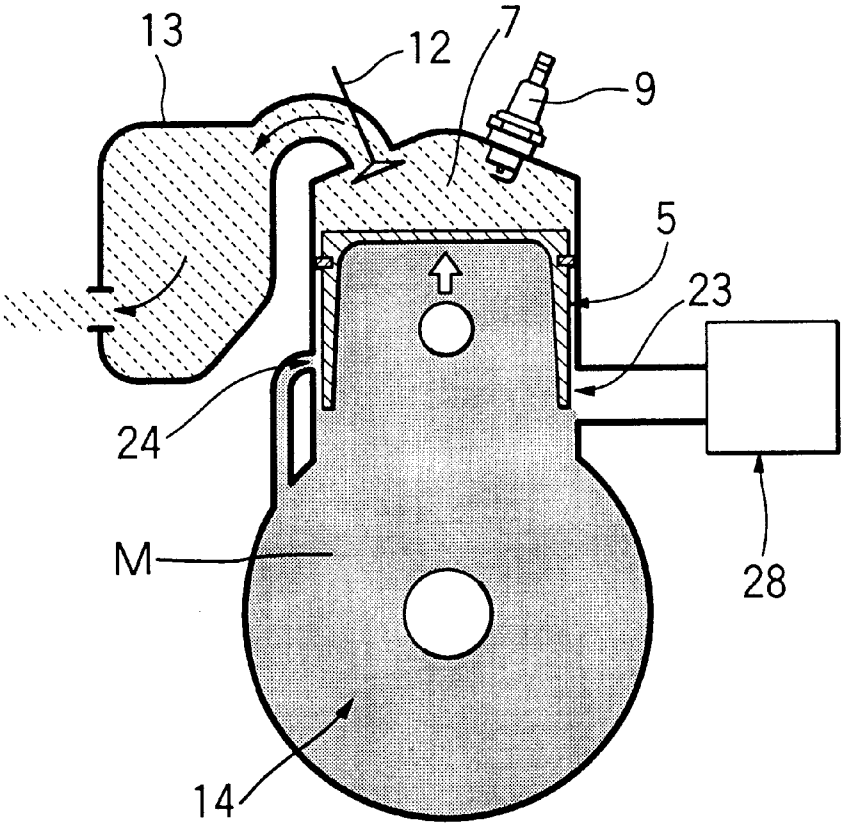
Figure 4J:
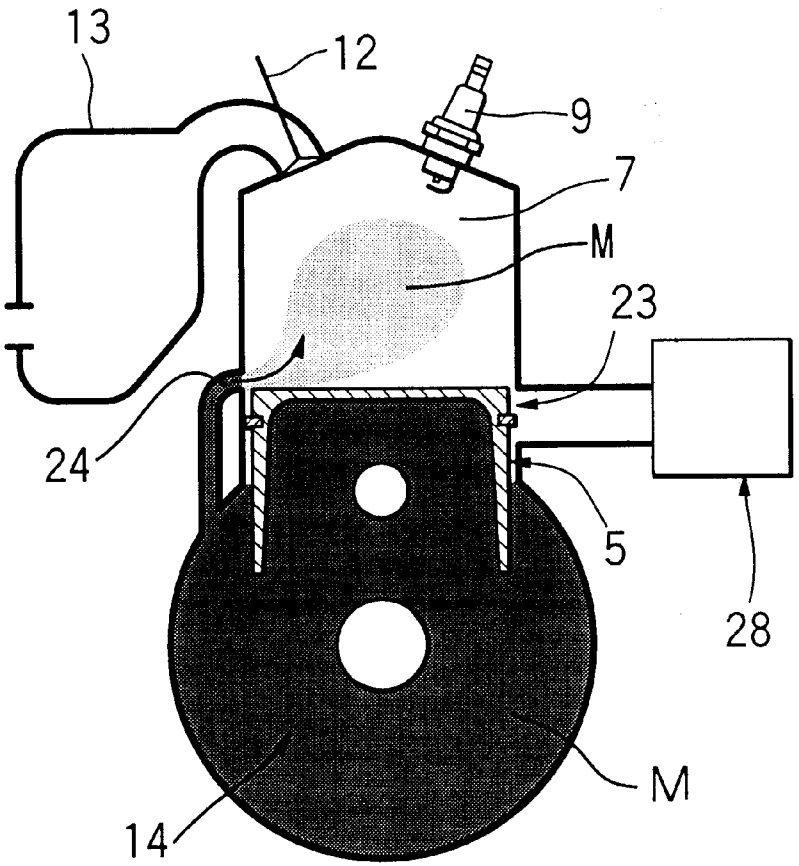
FIG. 4I and FIG. 4J illustrate the operation of the engine of the first embodiment and show the engine just after the completion of an exhaust stroke and the engine at an intake stroke during which the piston after the completion of an exhaust stroke is traveling downwardly to the bottom dead center and a mixture is streaming into the working chamber, respectively.

FIG. 4E shows the moment when the piston 5 substantially reaches the bottom dead center. As understood from this drawing, the intake port 24 is fully opened at this moment. However, if it is preferable to prevent a gas flow between the combustion chamber 7 and the crank chamber 14, the pressure difference between the combustion chamber 7 and the crank chamber 14 is made substantially zero at the moment when the intake port 24 begins to open. This setting can be accomplished by adjusting the timing to open the exhaust valve 12 as understood by those skilled in the art.

Figure 4I:
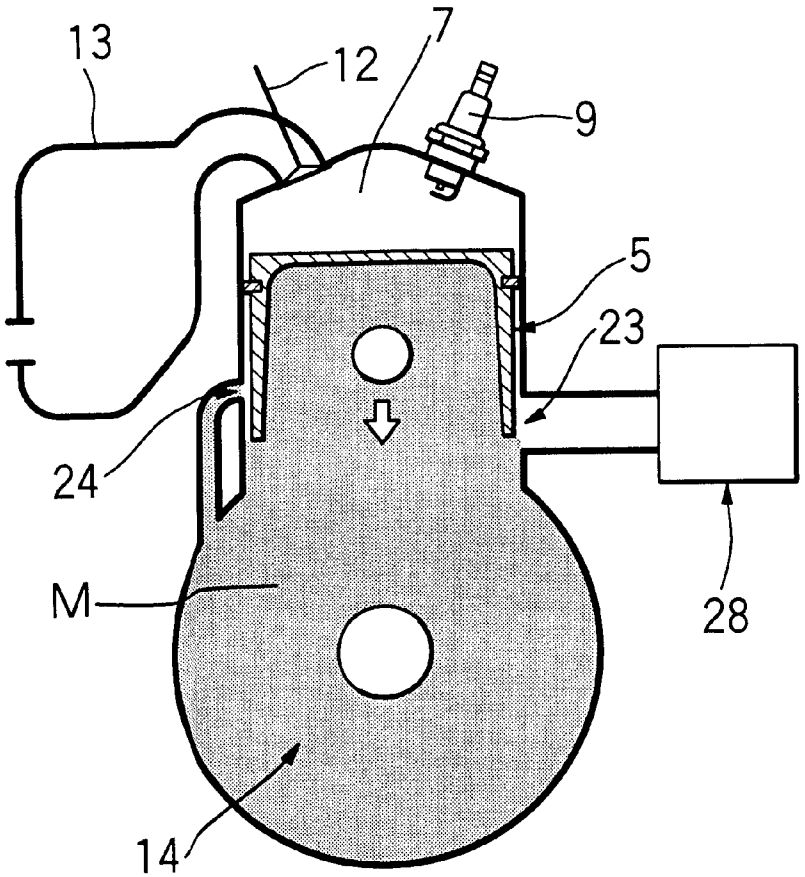

FIG. 4I shows a process for generating a negative pressure in the combustion chamber 7. In this process, the descending piston 5 generates a negative pressure in the combustion chamber 7 because the exhaust valve 12 is closed. In the crank chamber 14, the air-fuel mixture M which has already streamed into the crank chamber 14 is compressed by the piston 5. Due to this mechanism, the descending piston 5 makes the pressure in the combustion chamber 7 relatively low. On the other hand, it makes the pressure in the crank chamber 14 relatively high. When the descending piston 5 reaches the vicinity of the bottom dead center, the intake port 24 begins to open and follows an intake stroke during which the air-fuel mixture M in the crank chamber 14 streams into the combustion chamber 7 through this intake port 24. In other words, during this intake stroke, the air-fuel mixture pressurized in the crank chamber 14 streams into this combustion chamber 7 as if being absorbed into the combustion chamber 7 which has been reduced to a negative pressure (refer to FIG. 4J).

Figure 4L:
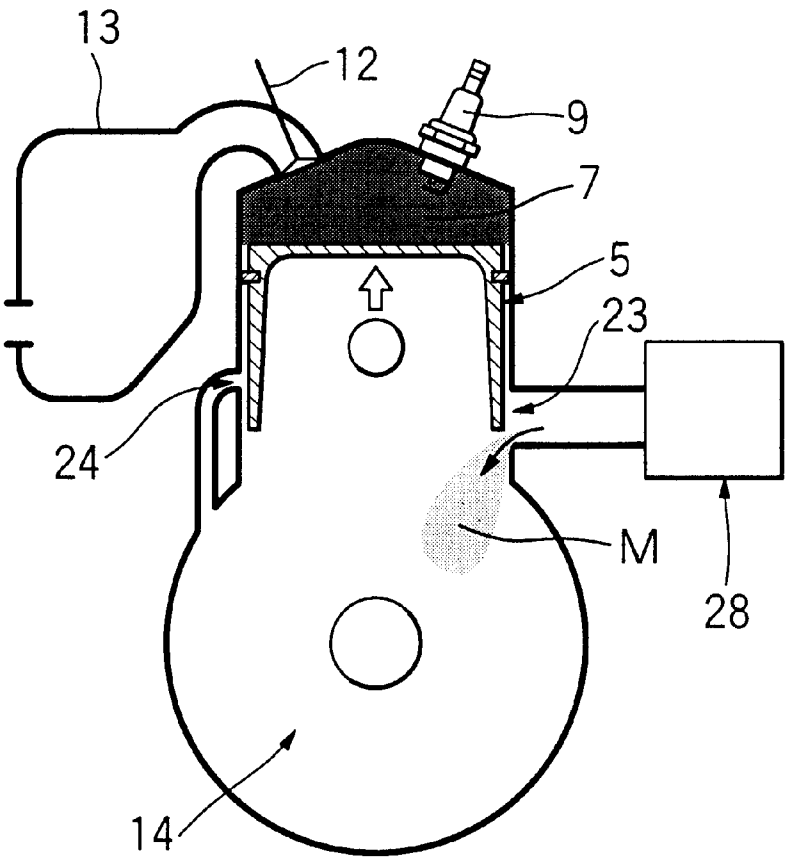
FIG. 4K and FIG. 4L illustrate the operation of the engine of the first embodiment and show the engine at a compression stroke just after the completion of an intake stroke and the engine at a final stage of the compression stroke, respectively.
Figure 4K:
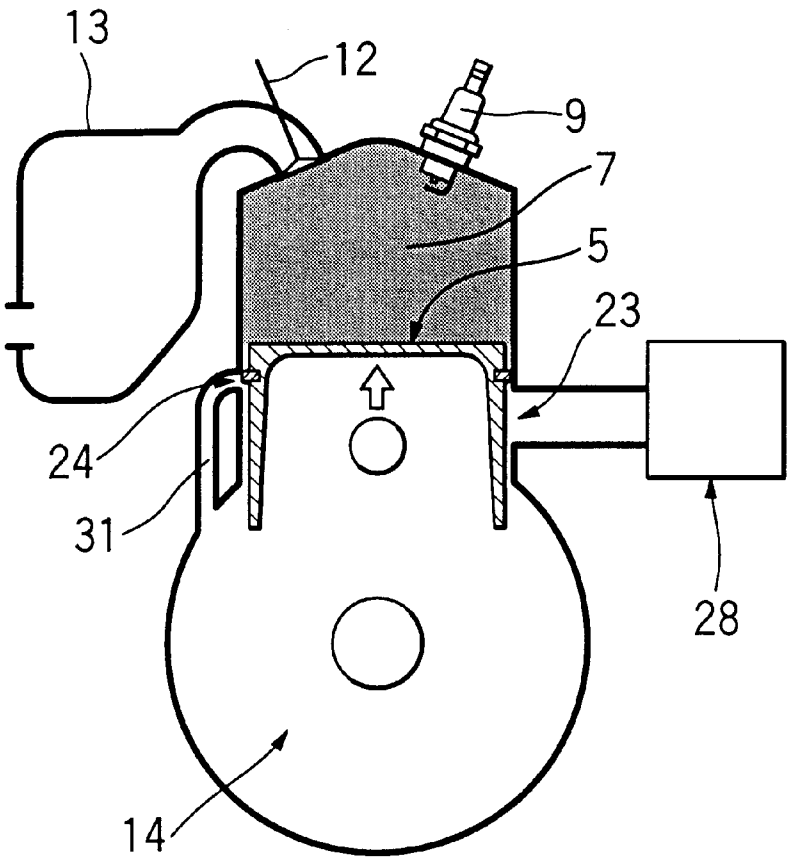
Figure 5:
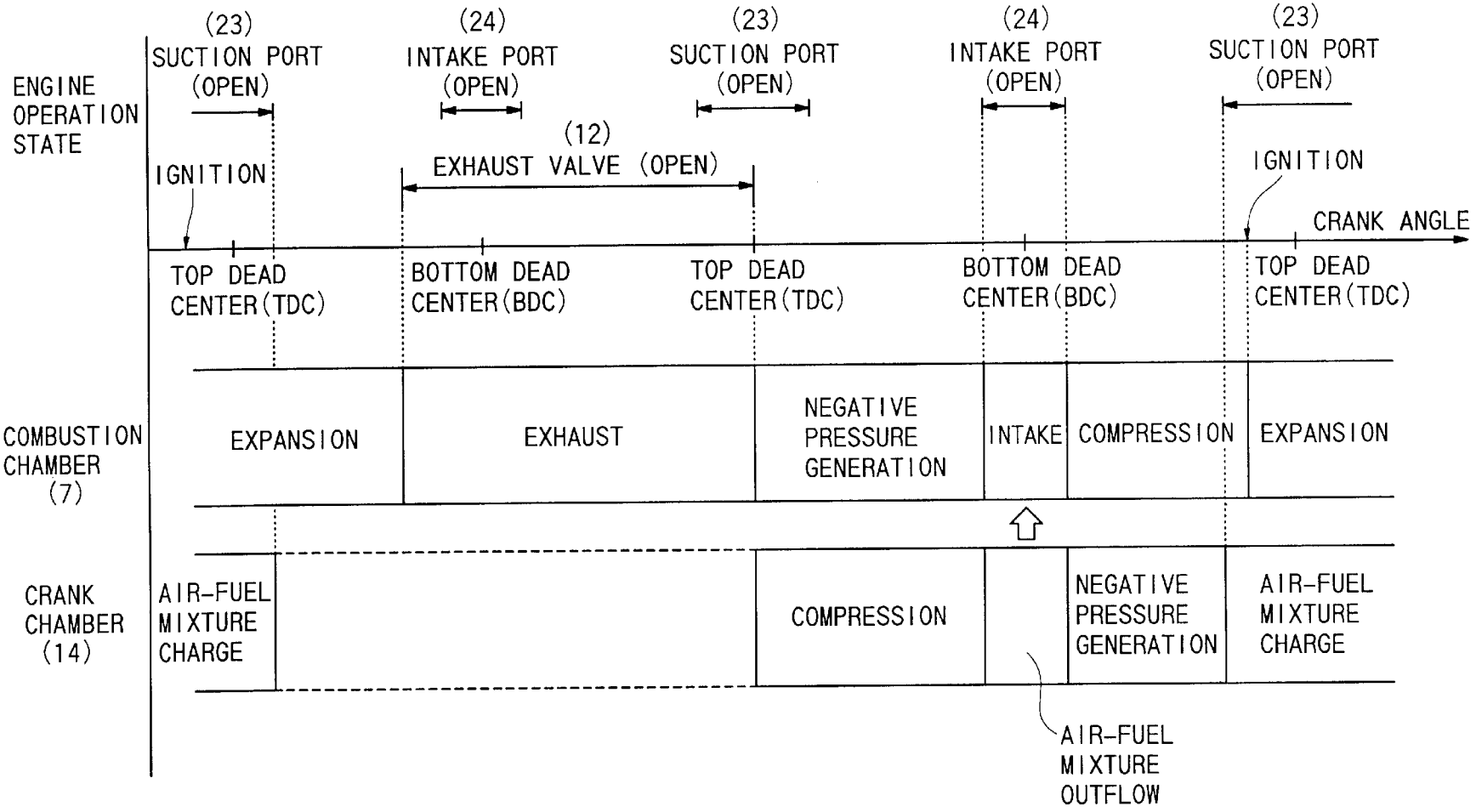
FIG. 5 is a diagram illustrating each stroke in a working chamber and a crank chamber during the steps of the operation of the engine shown in FIG. 4A to FIG. 4L.

FIGS. 4K and 4L show a compression process of the engine 1. This process is implemented by the rising piston 5 while the combustion chamber 7 is charged with the air-fuel mixture M. The rising piston 5 generates a negative pressure in the crank chamber 14. When the piston 5 reaches the vicinity of the top dead center, the suction port 23 opens and then the air-fuel mixture M begins to stream into the crank chamber 14 (refer to FIG. 4L). FIG. 5 tabulates the sequence of steps or states in the operation of the engine 1 referred to in FIG. 4A through FIG. 4L.

In the engine 1 as described above, since lubricating oil is supplied together with the air-fuel mixture M through the intake passage 26 into the crank chamber 14, the inside of the engine 1 is lubricated by the lubricating oil. Therefore, an oil pan generally provided in a four-stroke cycle engine is unnecessary. This eliminates restrictions on lay-out attitude of the engine 1. It also can reduce the height of the engine 1. It enables the effect to be achieved of an increased degree of freedom in the engine location, orientation and the layout around an engine.

In the engine 1, since the cylinder head 6 does not have an intake port and an intake valve which are generally provided in a four-stroke cycle engine and has only an exhaust port 10 and an exhaust valve 12, the layout position of the exhaust system, i.e., the muffler 13, can be selected without considering the layout of an intake system. Therefore, there is an advantage of an increased degree of freedom in designing a portable power working machine.

Since the engine 1 allows such intake system components as a carburetor or the like to be arranged on the side of the cylinder block 3 as in a conventional two-stroke cycle engine, a well-balanced overall layout of a compact portable power working machine is accomplished. Further, since the cylinder head 6 does not have an intake port and an intake valve which are generally provided in a four-stroke cycle engine and has only the exhaust port 10 and the-exhaust valve 12, the layout position of an exhaust system component, i.e., the muffler 13, can be selected without considering the layout of an intake system. Since the engine 1 does not have an intake valve as part of a valve system, it is simpler and lighter than a usual four-stroke cycle engine and it is preferable as a power source of a portable power working machine from this viewpoint. Since the engine 1 has a forcible exhaust system in the form of the piston 5, it allows more complete exhaust than the ordinary two-stroke cycle engine scavenged by fluid. It is favorable from the viewpoints of stable running and fuel economy.

Since the mechanical structure, in which the cylinder block 3 has formed threreon a first port and a second port 23, 24 which are opened and closed by the piston 5, is similar to that of the conventional two-stroke cycle engine as described above, there is an economical advantage that a t6o - stroke cycle engine production line can be used for manufacturing the four-stroke cycle engine 1 in accordance with the preferred embodiment making any changes thereto.

Figure 6:
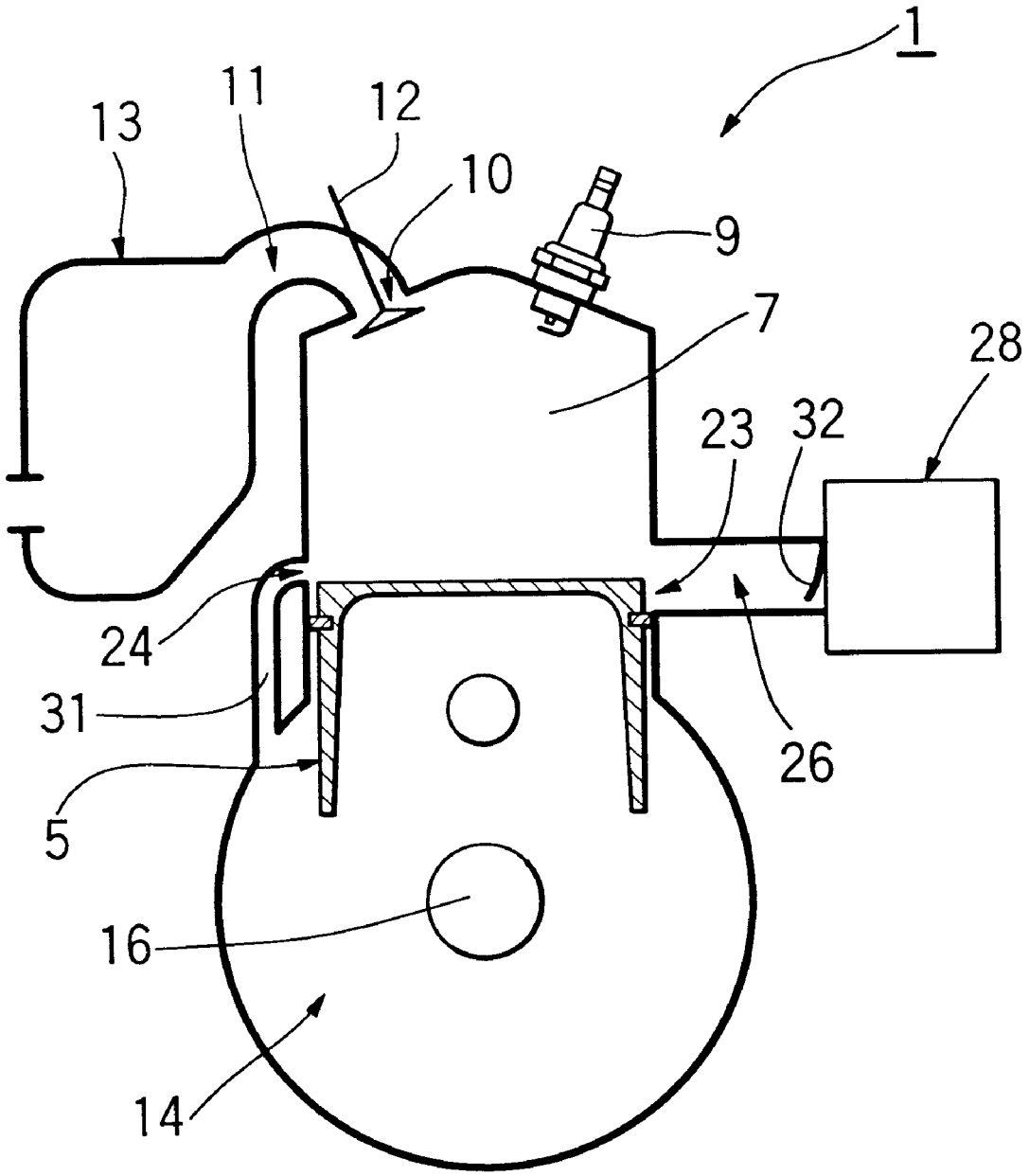
FIG. 6 is a conceptual structural diagram of an engine modified from the first embodiment and represented in FIG. 3.

The engine 1 has been described as a preferred embodiment of the present invention. The suction port 23 may be arranged, for example, so that the suction port 23 is half open when the piston 5 is in the vicinity of the bottom dead center, as illustrated in FIG. 6. In this case, there is the possibility that combustion gas in the combustion chamber 7 will flow back from the suction port 23 to the side of the carburetor 28. To eliminate this problem, a reed valve 32 may be installed as a check valve in the intake passage 26. In order to make it clear where this reed valve 32 is installed, it is represented by a dotted line in FIG. 1 and is shown as a solid line in FIG. 6. As for a system for supplying lubricating oil to the crank chamber 14, lubricating oil separated from gasoline may independently be supplied to the engine 1 through a separate line by-employing a separate oiling system well-known in a two-stroke cycle engine (refer to Japanese Utility Model Provisional Publications No. 203608 of 1989, 17107 of 1991, 44414 of 1992, etc.).

I claim:

1. A four-stroke cycle internal combustion engine, comprising:

a cylinder block having a bore formed therein and a bottom;

a piston slidably inserted into said bore of said cylinder block and having a bottom deal center;

a cylinder head disposed on top of said cylinder block;

a combustion chamber formed between said cylinder head and said piston;

an ignition plug mounted on said cylinder head;

an exhaust system component;

an exhaust port formed in said cylinder block and communicated with said exhaust system component;

an exhaust valve for opening and closing said exhaust port;

a crankcase connected to said cylinder block at said bottom thereof to form a closed crank chamber;

an intake system component;

a first port formed in said cylinder block so as to communicate with said combustion chamber and communicated with said intake system component for supplying lubricating oil together with fuel, said first port being opened and closed by said piston;

a second port formed in said cylinder block so as to communicate with said combustion chamber and being opened when said piston reaches a point in the vicinity of said bottom dead center, said second port being opened and closed by said piston; and a communicating passage communicating said second port with said crank chamber.

2. A four-stroke cycle internal combustion engine in accordance with claim 1, wherein said first port is arranged at a position where said first port is kept closed when said piston reaches the bottom dead center.

3. A four-stroke cycle internal combustion engine in accordance with claim 1, wherein said cylinder block has a side wall and said intake system component is installed on said side wall of said cylinder block.

4. A four-stroke cycle internal combustion engine in accordance with claim 2, wherein said cylinder block has a side wall and said intake system component is installed on said side wall of said cylinder block.

5. A four-stroke cycle internal combustion engine in accordance with claim 1, wherein said exhaust valve is set to open before said piston opens said second port as it travels downwardly.

6. A four-stroke cycle internal combustion engine in accordance with claim 2, wherein said exhaust valve is set to open before said piston opens said second port as it travels downwardly.

7. A four-stroke cycle internal combustion engine in accordance with claim 3, wherein said exhaust valve is set to open before said piston opens said second port as it travels downwardly.

8. A four-stroke cycle internal combustion engine in accordance with claim 4, wherein said exhaust valve is set to open before said piston opens said second port as it travels downwardly.

9. A four-stroke cycle internal combustion engine in accordance with claim 5, wherein said exhaust valve is set to open so that the pressure difference between said combustion chamber and said crank chamber comes to substantially zero when said piston opens said second port as it travels downwardly.

10. A four-stroke cycle internal combustion engine in accordance with claim 6, wherein said exhaust valve is set to open so that the pressure difference between said combustion chamber and said crank chamber comes to substantially zero when said piston opens said second port as it travels downwardly.

11. A four-stroke cycle internal combustion engine in accordance with claim 7, wherein said exhaust valve is set to open so that the pressure difference between said combustion chamber and said crank chamber comes to substantially zero when said piston opens said second port as it travels downwardly.

12. A four-stroke cycle internal combustion engine in accordance with claim 8, wherein said exhaust valve is set to open so that the pressure difference between said combustion chamber and said crank chamber comes to substantially zero when said piston opens said second port as it travels downwardly.

13. A four-stroke cycle internal combustion engine in accordance with claim 1, wherein said engine is an air-cooled type engine.

14. A four-stroke cycle internal combustion engine in accordance with claim 2, wherein said engine is an air-cooled type engine.

15. A four-stroke cycle internal combustion engine in accordance with claim 3, wherein said engine is an air-cooled type engine.

16. A four-stroke cycle internal combustion engine in accordance with claim 5, wherein said engine is an air-cooled type engine.

17. A four-stroke cycle internal combustion engine in accordance with claim 9, wherein said engine is an air-cooled type engine.

* * * * *